United States Patent [19]

Hueschen et al.

[11] 4,187,442

[45] Feb. 5, 1980

[54] ROTATING ANODE X-RAY TUBE WITH IMPROVED THERMAL CAPACITY

[75] Inventors: Robert E. Hueschen, Hales Corners; Richard A. Jens, Milwaukee, both of Wis.

[73] Assignee: General Electric Company, Schenectady, N.Y.

[21] Appl. No.: 939,540

[22] Filed: Sep. 5, 1978

[51] Int. Cl.[2] ..... H01J 35/10

[52] U.S. Cl. ..... 313/60

[58] Field of Search ..... 313/60, 330

[56] References Cited

U.S. PATENT DOCUMENTS

| | | | |
|---|---|---|---|
| 2,786,954 | 3/1957 | Atlee | 313/60 |
| 3,622,824 | 11/1971 | Atlee | 313/60 X |
| 3,634,870 | 1/1972 | Kessler | 313/330 X |
| 3,699,373 | 10/1972 | Holland et al. | 313/60 |
| 3,753,021 | 8/1973 | Braun | 313/60 |
| 3,855,492 | 12/1974 | Langer et al. | 313/60 |
| 4,004,174 | 1/1977 | Yashiro | 313/60 X |
| 4,097,759 | 6/1978 | Furbee et al. | 313/60 |

*Primary Examiner*—Palmer C. Demeo

*Attorney, Agent, or Firm*—Ralph G. Hohenfeldt

[57] ABSTRACT

A low thermally conductive columbium metal stem has a heavy refractory metal x-ray target disk fastened to one end. A high thermal conductivity rotor hub comprising a cup-shaped element is fastened to the other end of the stem and the rotor hub is fastened to the end of an induction motor cylinder or liner which is coated to enhance heat emission and is induced to rotate by being coupled to a rotating magnetic field. A low thermally conductive bearing hub is fastened to the inside of the rotor hub and to a shaft which is journaled for rotation in bearings. The bearing hub enhances thermal isolation of the bearings from the hot rotor hub and hot target.

7 Claims, 3 Drawing Figures

Fig. 1
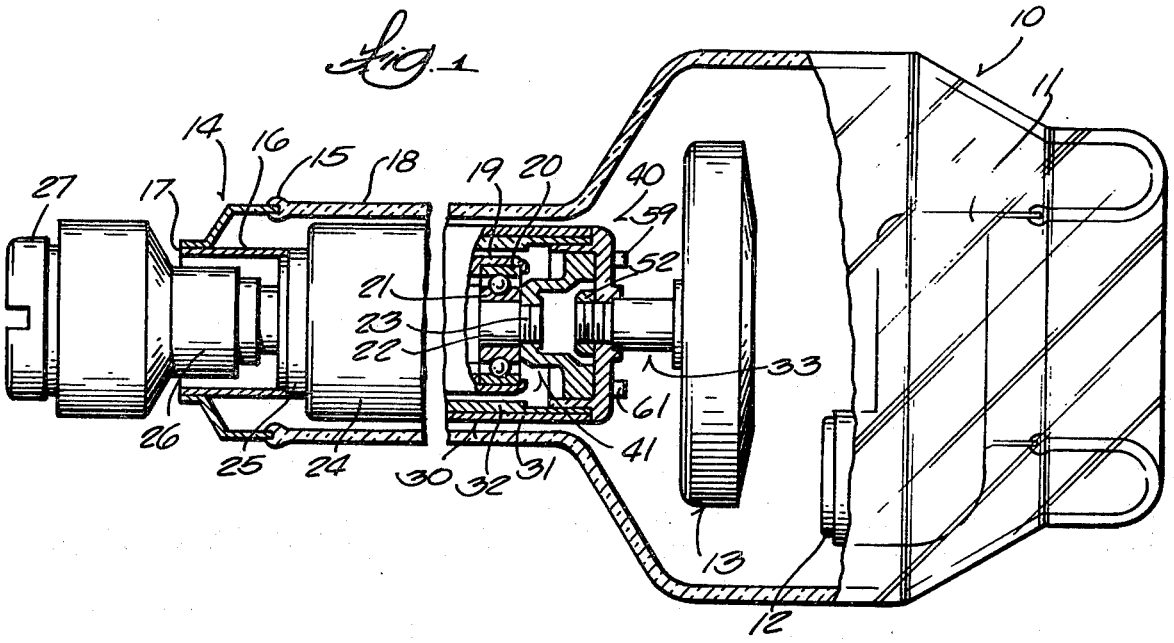
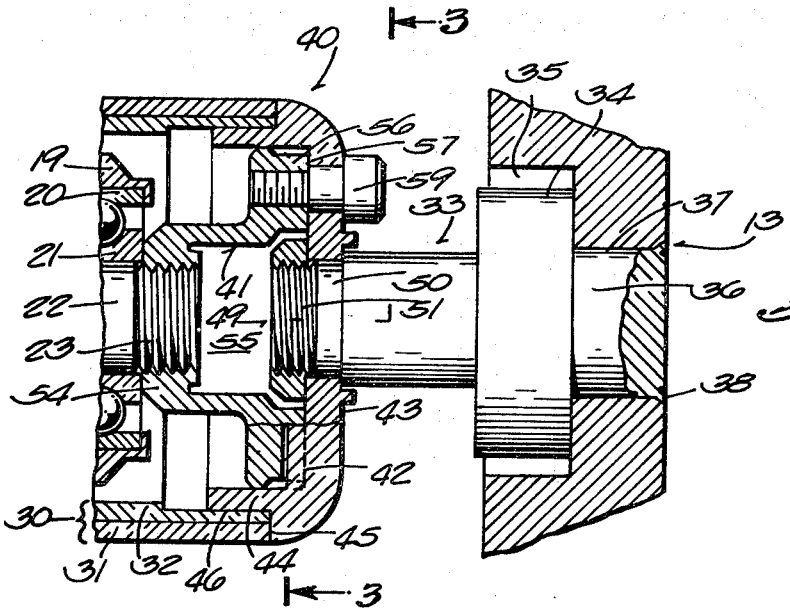
Fig. 2
Fig. 3
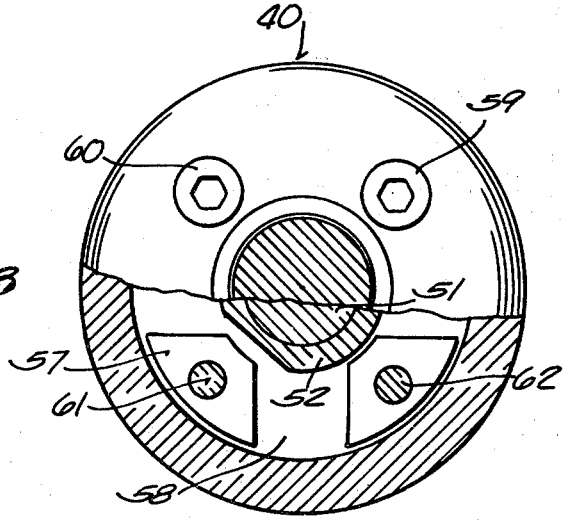

ROTATING ANODE X-RAY TUBE WITH IMPROVED THERMAL CAPACITY

This invention relates to rotating anode x-ray tubes and, in particular, to a construction which improves the thermal capacity of the tubes.

Many recently adopted x-ray examination procedures require high x-ray intensities for long exposure intervals. This is particularly true in procedures where stopping motion is desired such as when examining a moving organ or when following the path of a diagnostic opaque fluid as it advances through a blood vessel. In such cases a sequence of relatively high intensity and long duration x-ray exposures are made. Most of the energy of the electron beam impinging on an x-ray target is converted to heat in the target. In rotating anode tubes, the rotating target may reach temperatures as high as 1350° C. A substantial amount of this heat is radiated from the target and carried away by the cooling fluid, such as oil, in the x-ray tube housing or casing. Much of the heat, however, is conducted through the stem which supports the target to the rotating anode structure. This has a tendency to raise the temperature of the bearings on which the anode rotates to destructive levels. As is well-known, it is customary to coat the anode rotor structure with a material that has a high thermal emissivity so that the bearings and the tube as a whole will run cooler.

At the present time, a tube having a heat storage capacity of 350,000 heat units would be considered a high thermal capacity x-ray tube. Typically, a tube of this capacity might use a composite tungsten and molybdenum target which has a volume of about 4.5 cubic inches (73.74 cc) and a mass of about 1.9 pounds (0.86 kilograms).

However, x-ray tubes having a heat storage capacity of 700,000 to 1,000,000 heat storage units have been required for high energy procedures. The larger of these two tubes might typically use a target having a diameter of 4.0 inches (10 centimeters), a volume of 11.4 cubic inches (187 cc) and a mass of 4.3 pounds (1.95 kilograms), a thickness of 1.0 inch (2.54 cm) and a moment of inertia of about 9 inch$^2$ pounds. A typical high energy exposure sequence might result in 1,000,000 heat units being generated in the target itself. One could expect that 15% of this heat would have to be dissipated other than by radiant emission from the target. So much heat, if conducted through the bearings, would destroy them. The present invention enables keeping the bearing temperature below 450° C.

One prior art method of restricting the amount of heat conducted from the target to the anode rotor and its bearings is to couple the target disk to the rotor with a stem or tube made of a fairly high electrical conductivity material but relatively poor thermally conductive material such as columbium. Using a tubular instead of a solid cross section stem tended to restrict heat flow from the target. The target masses up to that time were not so great as to preclude supporting them on a hollow or tubular stem.

In the new high thermal capacity x-ray tubes which are the subject of the present invention, targets having a weight of about 1.95 kilograms and rotating at high speed while being extremely hot could not be safely supported on a hollow columbium stem so a solid stem had to be adopted. Typically, the solid stem causes an increase in thermal conduction to the rotor hub of about 130% over the tubular stem. Without taking the measures which are contemplated by the present invention, this increased heat conduction to the bearings would destroy them long before expiration of the acceptable expected life of the x-ray tube.

SUMMARY OF THE INVENTION

In accordance with the invention, means are provided for improving the thermal isolation between the bearings of a rotating anode structure and the x-ray target and for diverting much of the heat to the cylindrical induction motor liner from whose surface heat emission or radiation is augmented by having the liner coated with a high thermal emissive material. The massive x-ray tube target is supported on a solid or non-tubular columbium stem. The stem is fastened to a rotor hub which is made of a high heat conductivity material, particularly molybdenum or a molybdenum alloy known as TZM. This rotor hub is brazed in good heat exchange relationship to the rotor liner which radiates it from the x-ray tube envelope. A concentric bearing hub comprised of a high electrical conductivity and low heat conductivity metal is used to couple the rotor hub to the shaft which is journaled in the rotor bearings. This bearing hub not only restricts heat flow to the bearings by virtue of it being made of a low heat conductive material but also by virtue of it being shaped in such manner as to provide minimum cross section and a maximum length path for restricting heat flow.

A more detailed description of how the new high heat storage x-ray tube is constructed will now be set forth in reference to the drawing.

DESCRIPTION OF THE DRAWING

FIG. 1 shows a rotating anode x-ray tube with parts broken away and with other parts which are especially pertinent to the invention being shown in section;

FIG. 2 is an enlarged view of a portion of the x-ray tube shown in FIG. 1; and FIG. 3 is an end view of the anode rotor with parts broken away and parts in section taken along a line corresponding with 3—3 in FIG. 2.

DESCRIPTION OF A PREFERRED EMBODIMENT

The rotating anode x-ray tube in FIG. 1 has several conventional features which will be described first. The tube comprises a glass envelope 10. Borosilicate glass is used in this case as is common practice. A cathode structure 11, shown schematically, is sealed into the right end of the tube. The electrical conductors leading to the cathode structure 11 are not shown since cathode structures of this type are well-known. The cathode structure has a focusing cup 12 in which there is an electron emissive filament, not shown, which serves as usual to provide an electron beam that is attracted to the x-ray target 13 which, during tube operation, is at a high dc potential relative to the cathode focusing cup 12. Target 13 is a composite disk of refractory metals such as tungsten and molybdenum. During tube operation, target 13 may be rotated as high as 10,000 rpm and may reach operating temperatures as high as 1350° C. Targets in the high energy x-ray tubes contemplated herein may weigh about 4.3 pounds (1.95 Kg) and have a thickness of 1 inch and a diameter of 4 inches (10 cm).

In the left end of the tube in FIG. 1, envelope 10 has a ferrule 14 sealed into it as indicated by the glass-to-metal seal marked 15. A tubular element 16 is welded at its end to the end of the ferrule along a weld joint marked 17. Tubular element 16 extends axially through the neck 18 or reduced diameter portion of envelope 10 and, as can be seen by the part marked 19 and shown in section, provides a socket into which the outer race 20 of a ball bearing is swaged. The ball bearing includes an inner race 21 and there is a shaft 22 fitted tightly into the inner race. Shaft 22 has a threaded end 23. There is another ball bearing, not visible, within the part of the rotor structure which is marked 24. Metal sleeve 16 is hermetically sealed to a cylindrical element 25 which provides the outer bearing race support such as the one marked 19. A cylindrical conductor 26 connects to cylindrical element 25 and serves as a means for making a high voltage connection to the x-ray tube. The high voltage connection is established with a slotted screw 27. This screw also supports the x-ray tube in its housing, not shown.

A hollow laminated cylindrical element 30 is present for the usual purpose of acting as the rotor of an induction motor for rotating the anode. As is well-known, but not shown, the tube is used with electromagnetic field coils which surround neck 18 of the tube envelope for producing a rotating magnetic field that induces the rotor to rotate. The rotor cylinder 30 is a lamination of a copper outer cylinder 31 and an inner cylinder 32 of steel as is conventional.

Referring now to FIGS. 1 and 2, in accordance with the invention, x-ray target 13 is mounted on a stem 33 that is preferably made of columbium which exhibits the desirable properties of reasonably good strength at high temperature, low thermal conductivity compared to copper, for instance, and reasonably good electric conductivity. Because target 13 is so massive, columbium stem 33 is solid rather than tubular. As explained earlier, using a solid columbium stem is at the expense of having excessive heat conducted away from target 13 to the rotor bearings. Stem 33 has an integral radially extending flange 34 which fits into a counterbore 35 in the rear of target 13. The stem also has an extension 36 which fits tightly into a bore 37 in the target. The target is secured to the extension by upsetting or flaring it circumferentially in the region marked 38 as can be seen in FIG. 2.

Two unique parts, insofar as configuration and materials are concerned, of the rotor assembly are the rotor hub 40 and the bearing hub 41 as can be clearly seen in FIG. 2.

Rotor hub 40 is made from one of a group of high thermal conductivity alloys which will be identified more specifically later. As shown, rotor hub 40 is somewhat cup-shaped, having flat inner and outer end faces 42 and 43 and an axially extending side wall 44. The side wall is shouldered as at 45 for the end of the laminated rotor cylinder 30 to interface with the rotor hub 40 and form a joint 46 which is secured by brazing which is not visible because the braze metal has only the thickness of a film. Rotor hub 40 has a central bore for receiving the reduced diameter end 49 of columbium stem 33. Stem portion 49 has an unthreaded area 50 and a threaded area 51 at its end. Stem 33 is clamped to rotor hub 40 with a nut 52 which screws onto thread 51. Prior to assembly in an x-ray tube, the nut 52 and the stem portions 51 and 50 are brazed to rotor hub 40. This is done by placing a wafer of copper and gold brazing alloy on the end of the stem next to thread 51 and heating the subassembly in a vacuum furnace so that the braze metal flows along threads 51 and the threads in the nut and the other interfaces of stem 33 with hub 40. This makes the rotor hub 40 and stem 33 a unitary structure for practical purposes. As can be seen in FIG. 3, nut 52 has flat sides for permitting it to be engaged by a wrench, not shown, having a complementarily shaped socket.

After stem 33 is fastened by brazing into rotor hub 40, the rotor hub is brazed into the end of the laminated rotor cylinder or liner 30.

Referring further to FIG. 2, the bearing hub 41 will now be described. As explained earlier, bearing hub 41 is made from one of some low thermal conductivity metals which will be described in more detail later.

Bearing hub 41 is generally cup-shaped and has a concavity which is in opposition to the concavity of rotor hub 40. The bearing hub has an annular wall 53 which should preferably be made as thin as is commensurate with the required strength to reduce its cross section to the limit and, hence, reduce its heat conductivity in the axial direction. The end wall 54 of bearing hub 41 has a centrally threaded bore which mates with the threads 23 on rotatable rotor shaft 22. Bearing hub 41 is screwed onto shaft thread 23 before the rotor hub 40 and rotor liner 30 assembly are fastened to the bearing hub. Bearing hub 41 is preferably further secured to shaft 22 by tungsten-inert gas (TIG) welding at some time before final assembly of the rotor.

The concave bearing hub 41 defines a cylindrical space 55 which is void of any metal and, under the vacuum conditions prevailing in the finished x-ray tube, prevents flow of heat from target stem 33 to shaft 22 by conduction.

As can be seen in FIG. 2, bearing hub 41 includes an annular axially and radially extending flange portion 56. FIG. 3 shows that front face 57 of flange portion 56 is not circumferentially continuous but has slots 58 which define four bosses 57 so as to reduce contact area between flange 56 and the inner face 42 of rotor hub 40 in which case heat transfer from the rotor hub 40 to the bearing hub 41 is reduced.

After the subassembly which includes bearing hub 41 and the subassembly which includes rotor hub 40 are made up, the rotor hub 40 is assembled to bearing hub 41 with four socket headed screws 59–62.

In accordance with the invention, as explained above, rotor hub 40 which couples the x-ray target stem 33 to the laminated rotor liner 31, is made of a metal that has high heat conductivity and adequate electrical conductivity. Carbon-deoxidized molybdenum-based alloy made by the vacuum-arc casting process fulfills the requirements of the rotor hub. This alloy, which is commonly known as TZM, is available under the TZM designation from several manufacturers. It is composed of no less than 99.25% of molybdenum and might go up to 99.4%. Other essential components are about 0.4 to 0.55% of titanium and about 0.06 to 0.12% of zirconium. The balance is made up of controlled impurities such as carbon, iron, nickel, silicon, oxygen, hydrogen and nitrogen adding up to about 0.3%. TZM can be machined easier than molybdenum. It has good high temperature strength and thermal conductivity. Its thermal conductivity at 500° C. is about 0.29 calories per square centimeter, per centimeter length, per second, per °C.

Several alloys have been found to be satisfactory for the low heat conductivity bearing hub 41 which is used to suppress heat conduction from the rotor hub 40 to the anode structure bearings comprised of outer and inner races 20 and 21. All of the satisfactory alloys are nickel-based alloys and those which follow are preferred.

"Hastelloy B" and "Hastelloy B2," with the former being preferred over the latter. Alloys under the Hastelloy name are available from the Stellite Division of Cabot Corporation, 1020 W. Park Avenue, Kokomo, Indiana. Hastelloy B is 2.5% cobalt, 1% chromium, 28% molybdenum, 5% iron and the balance is nickel. Hastelloy B2 is about 28% molybdenum, 2% iron, 1% chromium, 1% cobalt, a maximum total of about 1.6% silicon, manganese, carbon, vanadium, phosphorous and sulfur and the balance is nickel.

Another suitable low thermal conductivity nickel-based alloy for the bearing hub 41 is called RA-333 which is available from Rolled Alloys, Inc., 5309 Concord Avenue, Detroit, Michigan 48211. The primary constituents of RA-333 are about 45% nickel, 25% chromium, 3% tungsten, 3% molybdenum, 3% cobalt, 18% iron, 1.25% silicon, 1.5% manganese and minor amounts of carbon, phosphorous and sulfur.

Other suitable nickel-based alloys for the bearing hub 41 are the "Inconel" alloys, particularly Inconel alloy 625 available from Huntington Alloys, Inc., Huntington, West Virgina (a division of International Nickel Company). The major constituents of Inconel 625 are about 61% nickel, 20–23% chromium, 8–10% molybdenum, 4% columbium and tantalum and 2.5% iron. Minor constituents, totalling about 2% are carbon, manganese, sulfur, silicon, aluminum, titanium, cobalt and phosphorous.

Available data shows that the thermal conductivity of the nickel-based alloys just suggested for the bearing hub 41 at the temperatures prevailing in anode rotors is almost as low in conductivity as alumina which is not even metallic and which could not be used because of a lack of strength and because it is a poor electrical conductor. The suggested alloys, on the other hand are strong when hot, are good enough electrical conductors and are poor heat conductors.

For the sake of comparison, based on presently available data, nickel, which has been commonly used for rotor hubs similar to the one marked 40 has a thermal conductivity of about 0.14 calories per square centimeter, per centimeter length, per second, per °C. at 500° C. The highly conductive rotor hub 40 of TZM molybdenum alloy used herein has a thermal conductivity of 0.29, more than twice as much as nickel. The poorly conductive bearing hub 41 of nickel-based alloys such as Hastelloy B has a thermal conductivity of 0.037, about one-fourth of nickel and Inconel has a conductivity of 0.039, also about one-fourth of nickel. Thus, in the new tube design, the rotor hub 40 alloy which has a thermal conductivity of 0.29 is at least 7.8 times as conductive as the bearing hub 41 alloy which has a conductivity of 0.037. Generally, the molybdenum-based alloy TZM suggested herein will have a conductivity of about 7 to 8 times the conductivity of the selected nickel-based alloy.

The brazing of nut 52 solidly to stem 33 and rotor hub 40 not only assures the locking of their respective threads for increased mechanical strength and safety (reliability) but nut 52 provides increased area of contact to rotor hub 40 for maximum heat flow from stem 33 to rotor hub 40 and liner 30 to achieve maximum thermal radiation from liner 30 which is coated with a high thermal emittance material.

The highly conductive rotor hub 41 made of TZM effectively diverts much of the heat from the target 13 to the rotor liner 30 which radiates it and the poorly conductive bearing hub 41 inhibits heat conduction from rotor hub to the bearings so they do not overheat. This enables the thermal capacity rating of the x-ray tube to be increased over prior x-ray tube designs which is the basic object of the invention.

We claim:

1. In a rotating anode x-ray tube comprising an envelope, a shaft journaled in bearings for rotation within said envelope, a rotatable x-ray target disk and a coaxial stem on which said disk is mounted, an elongated cylindrical element in said envelope surrounding said shaft concentrically and subject to be rotated under the influence of a magnetic field and treated on its surface for enhancing thermal emission, a rotor hub for coupling said stem to said cylindrical element and a bearing hub for coupling said rotor hub to said shaft, the improvement for increasing the thermal capacity of said tube by restricting the flow of heat flowing from said target disk to said bearings and by increasing the flow of heat flowing to said cylindrical element wherein:

said rotor hub is made of high thermally conductive molybdenum-based alloy having a conductivity at 500° C. of at least 0.29 cal/cm$^2$/cm/sec/°C. and is comprised of no less than 99.25% of molybdenum, said bearing hub is made of low thermally conductive nickel-based alloy having a conductivity at 500° C. of one-seventh or less than one-seventh of the conductivity of said molybdenum-based alloy and is comprised of no less than about 45% and no more than about 67% of nickel, and said stem is composed substantially of columbium and is non-tubular.

2. The x-ray tube as in claim 1 wherein said molybdenum-based alloy for said rotor hub is further defined as being composed of up to about 99.4% molybdenum, 0.4% to 0.55% titanium, 0.06% to 0.12% zirconium and the balance being controlled impurities up to about 0.3%.

3. The x-ray tube as in claim 1 wherein said nickel-based alloy for said bearing hub is further defined as being composed of about 28% molybdenum, 5% iron, 2.5% cobalt, 1% chromium and the balance being nickel.

4. The x-ray tube as in claim 1 wherein said nickel-based alloy for said bearing hub is further defined as being composed of about 28% molybdenum, 2% iron, 1% chromium, 1% cobalt, a maximum total of about 1.6% silicon, manganese, carbon, vanadium, phosphorous and sulfur, and the balance being nickel.

5. The x-ray tube as in claim 1 wherein said nickel-based alloy for said bearing hub is further defined as being composed of about 45% nickel, 25% chromium, 18% iron, 3% tungsten, 3% molybdenum, 3% cobalt, 1.25% silicon, 1.5% manganese and minor amounts of carbon, phosphorous and sulfur.

6. The x-ray tube as in claim 1 wherein said nickel-based alloy for said bearing hub is further defined as being composed of about 61% nickel, 20% to 23% chromium, 8% to 10% molybdenum, 4% columbium and tantalum, 2.5% iron and a total of about 2% of minor constituents.

7. The x-ray tube as in any one of claims 1, 2, 3, 4, 5 or 6 wherein:

said rotor hub has a generally concave configuration as defined by a radially extending front wall and an axially extending circular wall integral therewith, the concave side of said front wall being planar, said stem being fastened coaxially to said front wall, said bearing hub comprises a hollow generally cylindrical portion having a thread at one end and a radially extending flange portion at its other end which has an end face and a plurality of bosses spaced circumferentially about said end face, only said bosses being in contact relation with said planar wall of said rotor hub to further inhibit heat flow to said bearing hub, and screw means extending through said rotor hub front wall and threadingly engaged with said bosses, respectively, for securing said rotor hub to said bearing hub.

* * * * *